US011137135B2

(12) United States Patent
May

(10) Patent No.: US 11,137,135 B2
(45) Date of Patent: Oct. 5, 2021

(54) NAIL LIGHT

(71) Applicant: Robert Carl May, Pittsburgh, PA (US)

(72) Inventor: Robert Carl May, Pittsburgh, PA (US)

( * ) Notice: Subject to any disclaimer, the term of this patent is extended or adjusted under 35 U.S.C. 154(b) by 0 days.

(21) Appl. No.: 16/392,194

(22) Filed: Apr. 23, 2019

(65) Prior Publication Data

US 2019/0301725 A1 Oct. 3, 2019

Related U.S. Application Data

(63) Continuation of application No. 16/182,167, filed on Nov. 6, 2018, now abandoned.

(60) Provisional application No. 62/583,421, filed on Nov. 8, 2017.

(51) Int. Cl.
*F21V 33/00* (2006.01)
*F21Y 115/10* (2016.01)

(52) U.S. Cl.
CPC ..... *F21V 33/0004* (2013.01); *F21Y 2115/10* (2016.08)

(58) Field of Classification Search
CPC ..... A44C 15/00; A44C 15/008; A44C 15/009; A45D 31/00; F21V 33/0004; F21Y 2115/10
See application file for complete search history.

(56) References Cited

U.S. PATENT DOCUMENTS 2,234,657 A * 3/1941 Smaldone ..... A45D 29/001 132/285
5,086,378 A * 2/1992 Prince ..... F21V 21/08 362/103
5,632,548 A * 5/1997 Mayfarth ..... F21L 4/00 362/103
D413,183 S * 8/1999 Drake ..... D28/56
6,467,489 B1 * 10/2002 Christiansen ..... F21K 2/00 132/73
6,709,142 B2 * 3/2004 Gyori ..... A41D 19/0157 362/103
7,938,127 B1 * 5/2011 Maxwell ..... A45D 29/18 132/73.5
7,959,314 B1 * 6/2011 Rodriguez ..... F21V 33/0008 362/103
10,551,012 B2 * 2/2020 Schorr, III ..... F21L 4/00
10,677,436 B2 * 6/2020 Schorr, III ..... F21V 23/0435
10,772,408 B2 * 9/2020 Perkins ..... G02B 6/0065
10,856,640 B2 * 12/2020 Killips ..... F21V 31/005
2002/0112734 A1 * 8/2002 Rambeau ..... A45D 31/00 132/73
2003/0231485 A1 * 12/2003 Chien ..... F21S 2/00 362/84
2006/0007669 A1 * 1/2006 Blackburn ..... A41D 19/0157 362/103
2007/0084478 A1 * 4/2007 Tucker ..... A45D 31/00 132/73

(Continued)

*Primary Examiner* — Tsion Tumebo

(74) *Attorney, Agent, or Firm* — Bauer Law Offices; Robert M. Bauer

(57) ABSTRACT

This accessory product gives the user the freedom to bring to light the design or bling on the finger/toe nail at the users discretion. The crescent moon shape design Nail Light fits snugly with the bottom of the nail and the beginning of the finger or toe skin and the casing of the Nail Light can be manufactured in different colors. There is an option to decorate or cover the top of the Nail Light with a design or nail polish by the user.

18 Claims, 2 Drawing Sheets

(56) References Cited

U.S. PATENT DOCUMENTS

| | | | | |
|---|---|---|---|---|
| 2007/0181142 | A1* | 8/2007 | Tufts | A45D 31/00 132/73 |
| 2008/0289646 | A1* | 11/2008 | Fracassi | A45D 31/00 132/200 |
| 2009/0293896 | A1* | 12/2009 | Simpson | A45D 31/00 132/73 |
| 2011/0303237 | A1* | 12/2011 | Lieu | A45D 29/004 132/285 |
| 2012/0066936 | A1* | 3/2012 | Shepherd | A43B 3/001 36/137 |
| 2012/0140452 | A1* | 6/2012 | Martinez | G09F 13/22 362/103 |
| 2014/0026914 | A1* | 1/2014 | Glass | A45D 31/00 132/200 |
| 2014/0246037 | A1* | 9/2014 | Drake | F21V 33/0004 132/73.5 |
| 2014/0328053 | A1* | 11/2014 | Zealer | F21L 4/00 362/157 |
| 2015/0020291 | A1* | 1/2015 | Ammari | A41D 19/0013 2/163 |
| 2015/0121957 | A1* | 5/2015 | Lee | B22D 25/026 63/14.9 |
| 2015/0189971 | A1* | 7/2015 | Hakeem | A45D 31/00 132/200 |
| 2016/0295989 | A1* | 10/2016 | Hakeem | G09G 5/02 |
| 2017/0354227 | A1* | 12/2017 | Perkins | G02B 6/004 |
| 2019/0223575 | A1* | 7/2019 | Cephus | A44C 15/0015 |

* cited by examiner

NAIL LIGHT

This nonprovisional patent application is a continuation or nonprovisional patent application Ser. No. 16/182,167 filed on Nov. 6, 2018, which in turn claims priority to provisional patent application No. 62/583,421 filed on Nov. 8, 2017, and incorporates by reference in its entirety the contents of provisional patent application No. 62/583,421.

NOTICE OF COPYRIGHTS AND TRADE DRESS

A portion of the disclosure of this patent document contains materials that is subject to copyright protection. This patent document main shows and/or describes matter that is or may become trade dress belonging to the owner. The copyright owner and the trade dress owner have no objections to the facsimile reproduction by anyone of the patent disclosure as it appears in the patent and/or Trademark Office patent fees or records, but otherwise reserves all copyrights and trade dress rights whatsoever.

REFERENCE

| | | |
|---|---|---|
| D544.128 | June 2007 | Carro |
| D587832 | March 2009 | Bergmann |
| D618373 | December 2009 | Fukasawa |

TECHNICAL FIELD

This invention enhances the perception of the finger/toe nail of both the user and viewer, and allows the nail polish and/or nail bling to take on a new perception and a change of usage.

BACKGROUND

The opportunity to use light and/or colored light to enhance finger/toe nails for such things as design, personalization and statement making.

The present inventor, who describes fully in his claims, discloses a use of lighting and a way of application that is applied and removed without hindrance to the finger/toe nail.

SUMMARY

The present invention taps into an area of enhancing professional or personal work with finger/toe nails. It adds a light source without the appearance of discomfort or interference with a simple application and removal. The invention be parent from the following description.

In general, this accessories product, is comprised of a flexible rubber casing, LED lighting, battery, on-off click switch and adhesive. In general, in an aspect, the design of the rubber casing is in a crescent half moon shaped the basic size of the base of the finger/toe nail (sizes will slightly very). In general, in an aspect, the battery will be encased in the flexible rubber casing with the LED light in/on the side of the casing shining outward.

In general, in an aspect, the flexible rubber casing will be applied to the base of the nail so the LED light can shining up the nail's horizon illuminating the polish or bling.

In general, in an aspect, the flexible rubber casing will be held in place on the nail with the adhesive on the bottom of the flexible rubber casing.

In general, in an aspect, the flexible rubber casing will take the shape of the base of the nail to help conceal its application. There is an option to decorate or cover the top of the Nail Light with a design or nail polish by the user.

In general, in an aspect, the LED light will brighten and enhance the nail polish, the nail polish design and applied bling.

BRIEF DESCRIPTION OF DRAWINGS

The accompanying drawling's illustrate the embodiments of the invention and, along with the description, serve to explain the principles of the invention according to its embodiments. The design, will show the particular embodiments that are illustrated in the drawings. The present invention is more fully described in the claims.

DETAILED DESCRIPTION OF INVENTION

The originality of this invention comes from seeing women showing off their nail designs with their cell phone flashlights, often many times repeatedly. The thought of inventing a lighting device that shows nail design and nail bling became of interest to the inventor. The possibilities of putting light directly on the whole nail from the bottom of the nail became a reality after exploring the availability of its components. Although this accessory product was invented for women it is not limited for women. Men too can also use the nail light for such things as dance clubs, entertainment, and freedom of expression.

By using a mold to make a small flexible rubber casing with a cavity in the middle (from front to back) and making the casing approximately the width of the bottom of the nail, a small LED light (on the side) connected to a tiny battery with an on-off switch (backside), could be placed into the cavity. The casing would then be sealed with a small rubber cover. There is adhesive added to the bottom to secure the rubber casing to the bottom of the nail. Thus inventing a totally original accessories product. This accessories product would be water resistant.

When the Nail Light is placed on the bottom of a finger/toe nail, the user would click the on-off switch to on to on activate the LED light. The LED light would then illuminate the horizon of the nail and any design or bling on the nail. The LED light would also be available in different colors at the user's discretion.

The user would have choices of how many finger/toe nails they would want to use the Nail Light on and the option of time to leave the LED light on or off.

DESCRIPTION OF DRAWINGS

FIG. 1, Top

Figure 1:
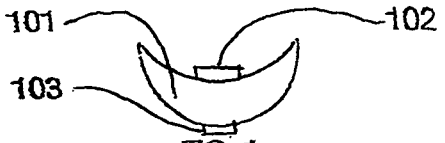

As shown in FIG. 1. The Nail Light (top). 101, rubber crescent moon shaped casing. 102, LED light. 103 on/off button.

Figure 2:
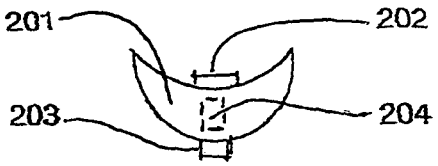

FIG. 2, Bottom and Interior

As shown in FIG. 2. the Nail Light (bottom) 201, rubber crescent moon shaped casing with adhesive. 202, LED light. 203, on/off button. 204, interior battery.

FIG. 3, Front

Figure 3:
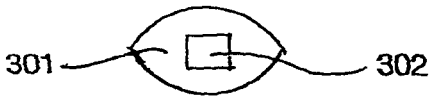

As shown in FIG. 3. The Nail Light (front) 301, rubber crescent moon shaped casing. 302, LED light.

FIG. 4, Back

Figure 4:
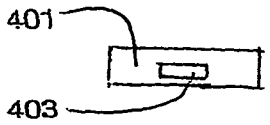

As shown in FIG. 4. The Nail Light (back). 401, rubber crescent moon shaped casing. 403, on/off button.

FIG. 5 PERSPECTIVE

Figure 5:
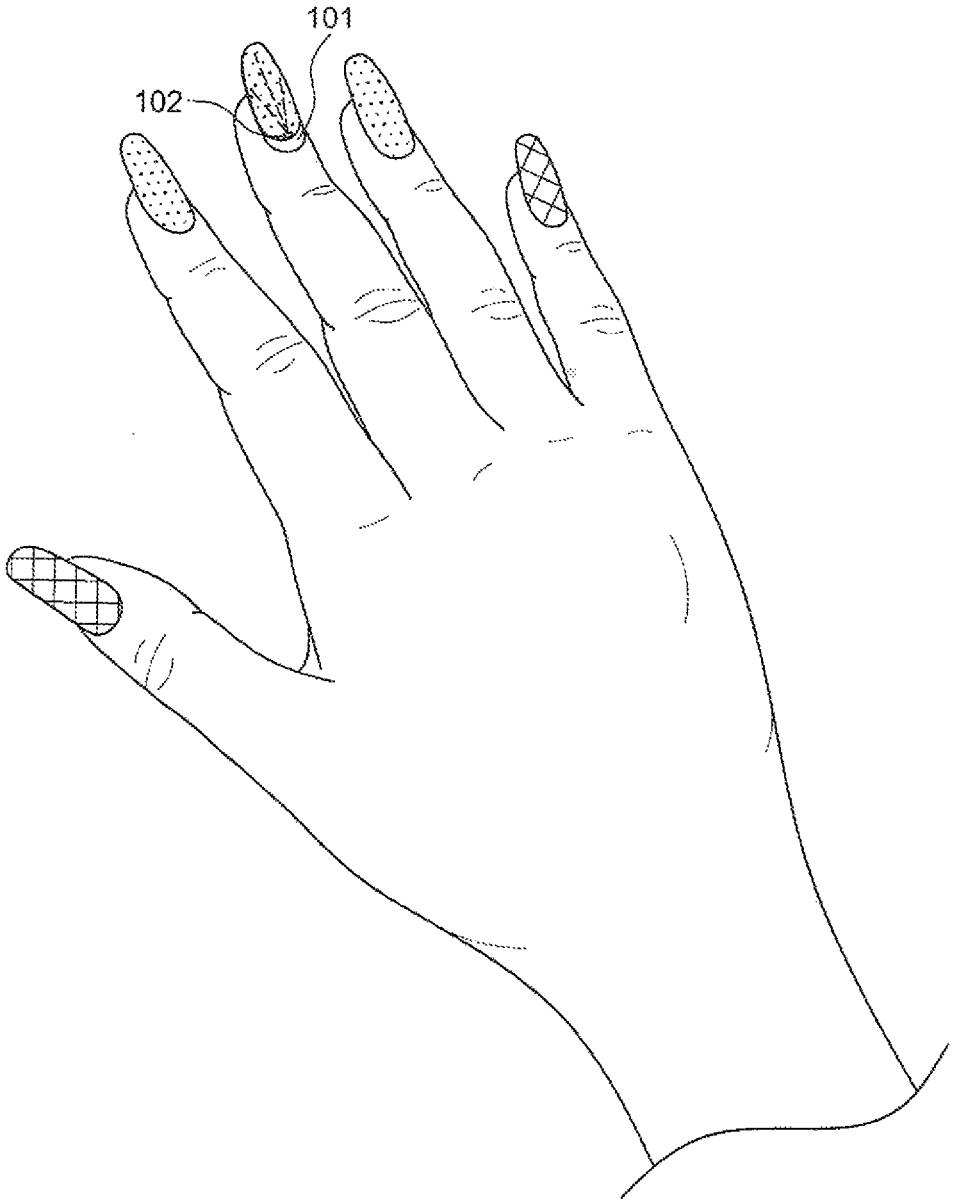

As shown in FIG. 5, the Nail Light has 101, rubber crescent moon shaped casing, 102, LED light, shining light away from the casing and toward the horizon of the nail.

The invention claimed is:

1. A product for use to change the appearance and to enhance the finger/toe nails, comprising:

nail polish, bling, and at least one nail light that allows the user to illuminate any art work, design work, nail polish work, and bling that may be on a respective one of the user's finger/toe nails with illuminating light from a light source in said nail light, said illuminating light being directed away from the nail light and onto the respective one of the user's finger/toe nails, using at least one of a plurality of different colors of light available from said at least one nail light, thereby giving the onlooker a brighter or different visual perception of the respective one of the user's finger/toe nails.

2. The product of claim 1 wherein said at least one nail light is made with rubber, LED lighting, battery, on-off switch and adhesive.

3. The product of claim 2 wherein said at least one nail light has a rubber casing with a crescent moon shape.

4. The product of claim 3 wherein said at least one nail light has adhesive on the bottom.

5. The product of claim 1 wherein said at least one nail light has a LED light that brightens the horizon of the nail.

6. The product of claim 5 wherein said at least one nail light comprises:

a casing, the casing having a top, a bottom, a front side and a back side;

adhesive on the top or bottom of the casing for securing the casing to the fingernail or toenail;

a battery inside the casing; and an on/off switch on the casing, the on/off switch when pushed by the user connecting the power in the battery to said light source, the light source being in the casing and providing said illuminating light directed away from the casing to illuminate any decoration on the finger nail or toe nail with illuminating light.

7. The product of claim 5 wherein the LED light has different colors selectable by the user.

8. The product of claim 2 wherein said at least one nail light comprises a plurality of nail lights, the plurality of nail lights having slightly varying sizes.

9. The product of claim 2 wherein the on-off switch when pushed would engage the battery onto the back of the LED light and turn on and when the on-off switch is pushed a second time the battery would disengage from the LED light and turn off.

10. The accessory product of claim 3, wherein the rubber casing has a color that matches the color of the nail polish or is part of the nail design itself.

11. A nail light for illuminating a fingernail or toenail at a user's discretion, comprising:

a casing, the casing having atop, a bottom, a front side and a back side;

adhesive on the top or bottom of the casing for securing the casing to the fingernail or toenail;

at least one light source in the casing which provides illuminating light directed away from the casing when tuned on;

a battery inside the casing; and an on/off switch on the casing, the on/off switch when pushed by the user connecting the power in the battery to said at least one light source to illuminate any decoration on the finger nail or toe nail with illuminating light.

12. A nail light according to claim 11, wherein the top and bottom of the casing have a crescent half moon shape substantially the same size width as a fingernail or toenail.

13. A nail light according to claim 11, wherein the illuminating light from said at least one light source is directed away from the casing onto the fingernail or toenail when turned on.

14. A nail light according to claim 11, wherein the illuminating light from said at least one light source is a colored light.

15. A nail light according to claim 14, wherein said at least one light source can provide different colors of illuminating light, and the user can select the color of illuminating light.

16. A nail light according to claim 15, wherein said at least one light source comprises a plurality of LED lights.

17. A nail light according to claim 11, wherein said casing a flexible rubber casing.

18. A nail light according claim 11, wherein the on/off switch is a button, and said at least one light source is turned on and off by pushes of the button.

* * * * *